US009704626B2

(12) United States Patent
Senda et al.

(10) Patent No.: US 9,704,626 B2
(45) Date of Patent: Jul. 11, 2017

(54) GRAIN-ORIENTED ELECTRICAL STEEL SHEET AND METHOD OF MANUFACTURING SAME

(75) Inventors: Kunihiro Senda, Tokyo (JP); Hirotaka Inoue, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 194 days.

(21) Appl. No.: 14/395,900

(22) PCT Filed: Apr. 26, 2012

(86) PCT No.: PCT/JP2012/002875
§ 371 (c)(1),
(2), (4) Date: Oct. 27, 2014

(87) PCT Pub. No.: WO2013/160955
PCT Pub. Date: Oct. 31, 2013

(65) Prior Publication Data
US 2015/0111004 A1 Apr. 23, 2015

(51) Int. Cl.
*H01F 1/147* (2006.01)
*C21D 1/26* (2006.01)
(Continued)

(52) U.S. Cl.
CPC ..... *H01F 1/14775* (2013.01); *B21B 3/02* (2013.01); *C21D 1/26* (2013.01); *C21D 8/12* (2013.01);
(Continued)

(58) Field of Classification Search
CPC ..... B21B 3/02; C21D 1/26; C21D 2201/05; C21D 8/12; C21D 8/1233; C21D 8/1244;
(Continued)

(56) References Cited

U.S. PATENT DOCUMENTS

2013/0129984 A1* 5/2013 Omura ..... C22C 38/00 428/167
2013/0160901 A1* 6/2013 Omura ..... C21D 8/12 148/537

FOREIGN PATENT DOCUMENTS

EP 0 775 752 A1 5/1997
EP 0 892 072 A1 1/1999
(Continued)

OTHER PUBLICATIONS

Supplemental European Search Report dated Aug. 12, 2015 of corresponding European Application No. 12875534.5.
(Continued)

*Primary Examiner* — Catherine A Simone
(74) *Attorney, Agent, or Firm* — DLA Piper LLP (US)

(57) ABSTRACT

A grain-oriented electrical steel sheet has low iron loss properties obtained though magnetic domain refining treatment by a chemical means. The steel sheet has a linear groove extending in a direction forming an angle of 45° or less with a direction orthogonal to a rolling direction of the steel sheet, in which presence frequency of fine grains with a length in the rolling direction of 1 mm or less in a floor portion of the groove is 10% or less, including 0% indicative of the absence of fine grains, the groove is provided with a forsterite film in an amount of 0.6 g/m$^2$ or more in terms of Mg coating amount per one surface of the steel sheet, and an average of angles (β angles) formed by <100> axes of secondary recrystallized grains facing the rolling direction and a rolling plane of the steel sheet is 3° or less.

1 Claim, 3 Drawing Sheets

(51) Int. Cl.

| | |
|---|---|
| ***C22C 38/00*** | (2006.01) |
| ***C22C 38/04*** | (2006.01) |
| ***C22C 38/02*** | (2006.01) |
| ***C21D 8/12*** | (2006.01) |
| ***C22C 38/06*** | (2006.01) |
| ***B21B 3/02*** | (2006.01) |
| ***C22C 38/60*** | (2006.01) |
| ***H01F 1/16*** | (2006.01) |
| ***C22C 38/16*** | (2006.01) |
| ***C25F 1/06*** | (2006.01) |
| ***C25F 3/06*** | (2006.01) |
| ***C25F 3/14*** | (2006.01) |

(52) U.S. Cl.

CPC ..... *C21D 8/1244* (2013.01); *C21D 8/1283* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/16* (2013.01); *C22C 38/60* (2013.01); *C25F 1/06* (2013.01); *C25F 3/06* (2013.01); *C25F 3/14* (2013.01); *H01F 1/16* (2013.01); *C21D 8/1233* (2013.01); *C21D 2201/05* (2013.01); *Y10T 428/24545* (2015.01)

(58) Field of Classification Search

CPC ..... C21D 8/1283; C22C 38/00; C22C 38/001; C22C 38/002; C22C 38/004; C22C 38/008; C22C 38/02; C22C 38/04; C22C 38/06; C22C 38/16; C22C 38/60; C25F 1/06; C25F 3/06; C25F 3/14; H01F 1/14775; H01F 1/16; Y10T 428/24545

See application file for complete search history.

(56) References Cited

FOREIGN PATENT DOCUMENTS

| | | | |
|---|---|---|---|
| EP | 1 227 163 | A2 | 7/2002 |
| JP | 55-110732 | | 8/1980 |
| JP | 57-2252 | | 1/1982 |
| JP | 62-53579 | | 11/1987 |
| JP | 62-54873 | | 11/1987 |
| JP | 3-69968 | | 11/1991 |
| JP | 6-72266 | | 9/1994 |
| JP | 7-268474 | | 10/1995 |
| JP | 9-157745 | | 6/1997 |
| JP | 10-226819 | | 8/1998 |
| JP | 2007-246973 | | 9/2007 |
| JP | 2009-144209 | A | 7/2009 |
| JP | 2012-36446 | | 2/2012 |
| JP | 2012-77380 | | 4/2012 |
| JP | 2012-126973 | | 7/2012 |

OTHER PUBLICATIONS

Corresponding Notification of Reasons for Refusal of JP 2010-280752 dated Nov. 11, 2014 with English translation.

Notice of Grounds for Rejection dated Oct. 27, 2015 of corresponding Korean Application No. 2014-7029128 along with an English translation.

Chinese Search Report dated Nov. 19, 2015 of corresponding Chinese Application No. 201280072609.9 along with an English translation.

* cited by examiner

GRAIN-ORIENTED ELECTRICAL STEEL SHEET AND METHOD OF MANUFACTURING SAME

TECHNICAL FIELD

This disclosure relates to a grain-oriented electrical steel sheet utilized for an iron core material of a transformer or the like, and a method of manufacturing the grain-oriented electrical steel sheet.

BACKGROUND

Grain-oriented electrical steel sheets are mainly utilized as iron cores for transformers and are required to have excellent magnetic properties, in particular low iron loss.

In this regard, it is important to highly accord secondary recrystallized grains of steel sheets with the (110)[001] orientation (or so-called Goss orientation) and reduce impurities in product steel sheets.

However, there are limitations in controlling crystal orientation and reducing impurities in terms of balancing with manufacturing cost, and so on. Thus, a method of applying linear strain to grain-oriented electrical steel sheets to narrow magnetic domain widths and reduce iron loss, is well known.

Techniques to narrow magnetic domain widths and improve iron loss properties as described above include a non-heat resistant magnetic domain refining method where a thermal strain region is linearly disposed (e.g. refer to JP S57-2252B or JP H06-72266B) and a heat resistant magnetic domain refining method where a linear groove with a predetermined depth is disposed on the steel sheet surface (e.g. refer to JP S62-53579B or JP H03-69968B).

JP S62-53579B discloses a means of forming a groove by using a gear type roller, and JP H03-69968B discloses a means of forming a groove by pressing an edge of a blade against a steel sheet after final annealing. These means are advantageous in that the magnetic domain refining effect on the steel sheet does not dissipate through heat treatment and that they are also applicable to wound iron cores and the like.

We found the following problems.

First, in conventional non-heat resistant magnetic domain refining methods such as disclosed in the aforementioned JP S57-2252B and JP H06-72266B, formation of a base film on the floor of a groove is insufficient and, therefore, tension received from the base film or the insulating tension coating is made insufficient in the groove part and steel substrate in the vicinity thereof. Because of this, sufficient iron loss reduction effect could not be obtained in many cases.

On the other hand, in heat resistant magnetic domain refining methods such as disclosed in the aforementioned JP S62-53579B or JP H03-69968B, fine grains are generated under the groove through flattening annealing due to strains formed in mechanical working. If the fine grains exist in an appropriate amount, they would contribute to magnetic domain refining and exhibit an effect of reducing iron loss. However, it is difficult to appropriately control the generation amount of fine grains. Further, if there is a large generation amount, magnetic permeability deteriorates and a desirable iron loss reducing effect cannot be obtained.

Another method of forming a groove is a method such as the so-called etching where insulating coating is removed linearly during or after final annealing (e.g. refer to JP S62-54873B). However, with this method, there was a problem in that because of the absence of a base film in the groove part, disturbances in the magnetic domain tend to occur in the vicinity of the groove part and, therefore, iron loss is not sufficiently improved.

It could therefore be helpful to provide a grain-oriented electrical steel sheet having low iron loss properties by applying magnetic domain refining treatment to a grain-oriented electrical steel sheet by forming a groove by a chemical means, and an advantageous manufacturing method of obtaining such steel sheet.

SUMMARY

We found that, when magnetic domain refining is performed by linear grooves, it is preferable to guarantee proper tension of the base film (forsterite film) where the grooves are formed, to set angles (β angles) formed by <100> axes of secondary recrystallized grains facing the rolling direction of the steel sheet and the rolling plane to a predetermined value or less, and to minimize generation of fine crystal grains under the grooves to stably obtain low iron loss properties.

We thus provide:

1. A grain-oriented electrical steel sheet comprising a linear groove formed on a surface thereof and extending in a direction forming an angle of 45° or less with a direction orthogonal to a rolling direction of the steel sheet, wherein presence frequency of fine grains with a length in the rolling direction of 1 mm or less in a floor portion of the groove is 10% or less, including 0% indicative of the absence of fine grains, the groove is provided with a forsterite film in an amount of 0.6 g/m$^2$ or more in terms of Mg coating amount per one surface of the steel sheet, and an average of angles (β angles) formed by <100> axes of secondary recrystallized grains facing the rolling direction and a rolling plane of the steel sheet is 3° or less.

2. A method of manufacturing a grain oriented electrical steel sheet, the method comprising:

subjecting a steel slab to a rolling process including cold rolling to obtain a steel sheet with a final sheet thickness, the steel slab containing by mass %

C: 0.01% to 0.20%,

Si: 2.0% to 5.0%,

Mn: 0.03% to 0.20%, sol. Al: 0.010% to 0.05%,

N: 0.0010% to 0.020%, at least one element selected from S and Se in a total of 0.005% to 0.040%, and the balance including Fe and incidental impurities;

then forming, by a chemical means, a linear groove extending in a direction forming an angle of 45° or less with a direction orthogonal to a rolling direction of the steel sheet;

then subjecting the steel sheet to decarburization annealing;

then applying an annealing separator thereon mainly composed of MgO;

then subjecting the steel sheet to final annealing to manufacture a grain oriented electrical steel sheet, wherein the MgO used has a viscosity in a range of 20 cP to 100 cP 30 minutes after mixing with water, and during the final cold rolling in the entire cold rolling, the steel sheet is subjected to rolling at least once during which an entry temperature or a delivery temperature of a rolling stand, whichever is higher, is 170° C. or lower, and to rolling at least twice during which the higher temperature of the two is 200° C. or higher.

3. The method of manufacturing a grain oriented electrical steel sheet according to aspect 2, wherein the steel slab further contains by mass % at least one element selected from Cu: 0.01% to 0.2%, Ni: 0.01% to 0.5%, Cr: 0.01% to 0.5%, Sb: 0.01% to 0.1%, Sn: 0.01% to 0.5%, Mo: 0.01% to 0.5% and Bi: 0.001% to 0.1%.

4. The method of manufacturing a grain oriented electrical steel sheet according to aspect 2 or 3, wherein the chemical means is electrolytic etching or pickling treatment.

5. The method of manufacturing a grain oriented electrical steel sheet according to any one of aspects 2 to 4, wherein the rolling process including cold rolling includes subjecting the steel slab to heating and subsequent hot rolling to obtain a hot rolled sheet, then subjecting the steel sheet to hot band annealing, and subsequent cold rolling once, or twice or more with intermediate annealing performed therebetween until reaching a final sheet thickness.

It is possible to obtain a grain oriented electrical steel sheet having an excellent iron loss reduction effect by forming a groove by a chemical means.

BRIEF DESCRIPTION OF THE DRAWINGS

Our steel sheets and methods will be further described below with reference to the accompanying drawings, wherein.

DETAILED DESCRIPTION

Figure 1:
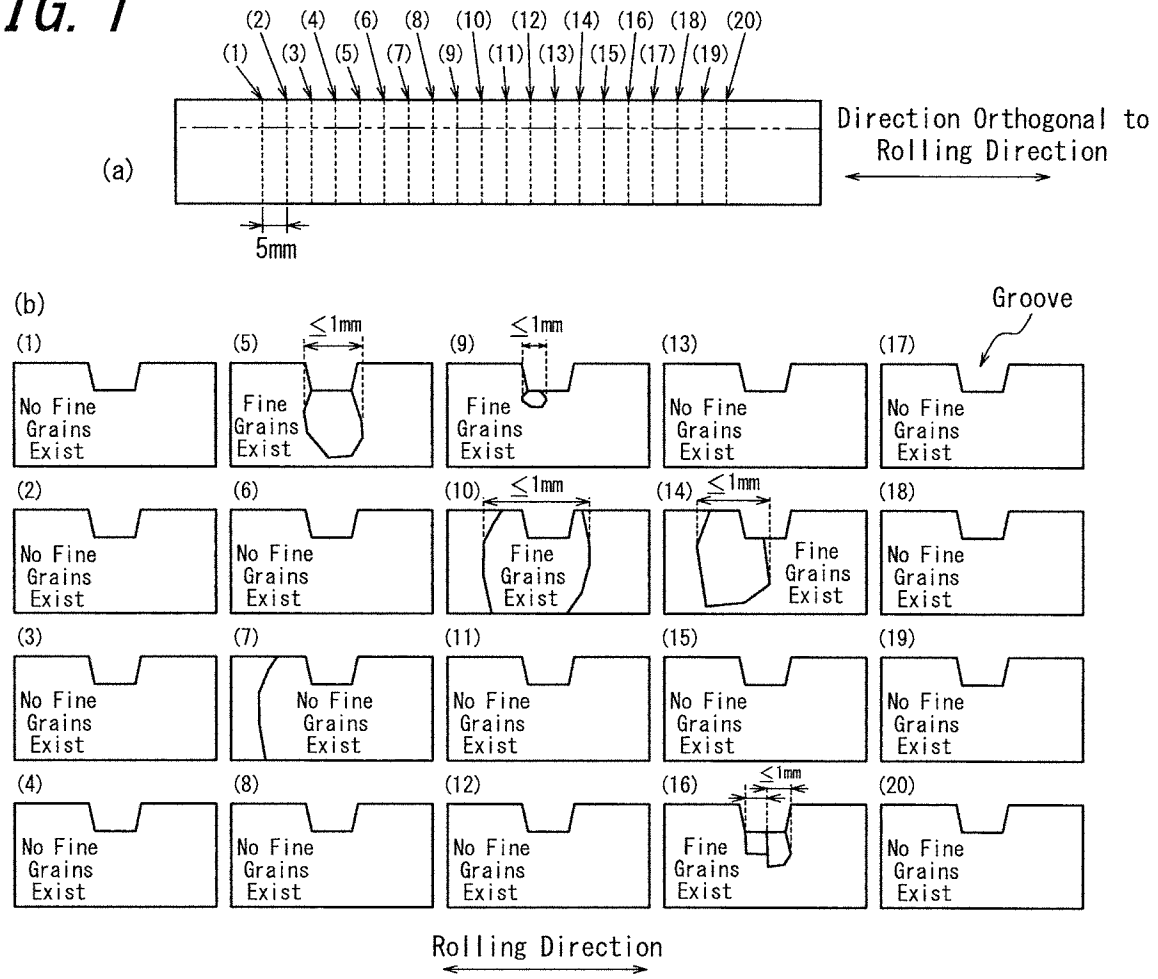
FIG. 1 shows how to determine the presence frequency of fine grains in the floor portions of grooves.

First, proper tension of the base film in the groove part can be guaranteed by controlling the formation amount of forsterite $Mg_2SiO_4$ by the following means.

Next, if an angle (hereinafter referred to simply as "β angle") formed by <100> axes of secondary recrystallized grains facing the rolling direction and a rolling plane of the steel sheet is large, Lancet magnetic domains are generated in the vicinity of grooves and the magnetic domain refining effect, which would otherwise be obtained from magnetic charges in the wall surfaces of the grooves, is reduced. Therefore, the β angle must be a predetermined value or less. However, even if the β angle is a predetermined value or less, if the tension on iron substrate from the coating of the above described groove part is small, a closure domain is generated in the vicinity of the groove part and the width of the 180° magnetic domain is widened, and a sufficient iron loss reduction effect cannot be obtained. Therefore, it is necessary to guarantee proper tension of the base film as described above and control the β angle at the same time.

Further, under such condition where tension of the base film in the groove part is sufficiently enhanced, sufficient magnetic domain refining effect is expected to be obtained. However, when fine grains are generated under the grooves, excessive magnetic charges are formed in the grain boundaries of secondary recrystallized grains and the fine grains, which results in reduced magnetic permeability and rather, higher iron loss. Therefore, it is necessary to reduce the presence frequency of fine grains.

That is, it is most important to guarantee proper tension of the base film as described above, control the β angle, and reduce formation of fine grains under the grooves at the same time.

Angle Formed by Linear Groove and Direction Orthogonal to Rolling Direction of Steel Sheet It is necessary for the angle formed by each linear groove and a direction orthogonal to a rolling direction of the steel sheet to be 45° or less to generate magnetic charges in the wall surfaces in the groove part and refine magnetic domains. This is because if the angle formed by the linear groove and the direction orthogonal to the rolling direction of the steel sheet exceeds 45°, iron loss reduction effect is decreased.

Further, it is preferable for the grooves formed in the steel sheet surface to have a width of 50 μm to 300 μm, depth of 10 μm to 50 μm, and an interval of around 1.5 mm to 10.0 mm. As used herein, the term "linear" is intended to include solid lines as well as dotted lines, dashed lines, and so on.

Frequency of Fine Grains Under Grooves

If fine grains exist excessively under the grooves, a demagnetizing effect of the grooves themselves and the magnetic charges formed in the grain boundaries of secondary recrystallized grains and fine grains become excessive and decrease magnetic permeability. As a result, the iron loss improving effect provided by the grooves becomes insufficient. However, a desirable iron loss reduction effect cannot be obtained by simply reducing fine grains under the grooves. That is, it is crucial to form sufficient base films in the grooves to sufficiently enhance the tension applied to the iron substrate by the coating in the magnetic domains, and further to finely control the magnetic domains in the grooves from which 180° magnetic domains of parts other than the groove part originate to thereby sufficiently derive the magnetic domain refining effect the linear grooves have.

As mentioned earlier, inhibiting generation of fine grains in the floor portions of the grooves, is advantageous in obtaining a stable iron loss reducing effect. Fine grains are crystal grains with grain size of 1 mm or less. Further, the presence frequency of fine grains under the grooves is the frequency (ratio) of fine grains present under the grooves when observing the cross-sectional structure of crystal grains in the groove part of the steel sheet. Specifically, as shown in FIG. 1, determination is made on whether crystal grains with a length in the rolling direction of 1 mm or less exist among the crystal grains which are in contact with the floor portions of the grooves, and the ratio of presence of such crystal grains (fine grains) among the investigated cross sections is to be made 10% or less. FIG. 1 is a schematic diagram of the cross section of grooves viewed from the direction orthogonal to the rolling direction of the steel sheet when observation is made in a direction along the grooves from 20 views with 5 mm intervals. Among the 20 views, 5 views show the corresponding fine grains, and therefore the frequency is $5/20 \times 100 = 25\%$. Regarding the fine grains here, crystal grains with at least a part thereof overlapping with the floor portions of grooves and having a length in the rolling direction of 1 mm or less are counted, as shown in FIG. 1.

Regarding the views for cross-sectional observation, it is desirable from the perspective of ensuring evaluation accuracy that observation is performed from 20 views or more (preferably, at positions spaced by 2 mm or more along the linear groove).

Amount of Forsterite Film of Groove Part (in Terms of Mg Coating Amount)

As described above, to sufficiently derive an iron loss reducing effect obtained from the linear groove, it is necessary to sufficiently guarantee not only the β angle in the vicinity of the groove part discussed later but also the film tension in the vicinity of the groove part. To this end, it is important that a base film is sufficiently formed inside the grooves. To sufficiently enhance film tension on the groove part, it is important to sufficiently form the base film (forsterite film). By doing so, it is possible to obtain the tension imparting effect of the base film itself, and also improve adhesive properties with the overcoated insulating tension coating to strengthen the tension applied to the iron substrate as a total.

Here, the coating amount (coating mass per unit area of one surface of the steel sheet) of Mg in the groove part is used as an index of the formation amount of forsterite ($Mg_2SiO_4$) which is the main component of the base film, and if the coating amount is less than 0.6 g/m$^2$, the above effect cannot be sufficiently obtained. Therefore, the Mg coating amount in the groove part per one surface of the steel sheet is 0.6 g/m$^2$ or more. Although there is no particular limit on the upper limit of the Mg coating amount, the amount is preferably around 3.0 g/m$^2$ from the perspective of preventing deterioration of the appearance of the coating of parts other than the groove part.

Further, the Mg coating amount in the groove part can be obtained by methods such as a method of performing analyzation/quantification using X-rays and electron rays, and a method of measuring the Mg coating amount in the whole steel sheet and parts other than the groove part, and area ratio of the groove part and calculating the Mg coating amount in the groove part. In the present invention, even if Ti, Al, Ca, Sr or the like are contained in the forsterite film, there is no problem as long as the total amount thereof is 15 mass % or less.

Average Value of β Angle

If the average of β angles of the whole steel sheet is large, the possibility of the β angle in the vicinity of the groove part becoming large increases, and lancet magnetic domain (closure domain) is generated and, for this reason, the magnetic domain refining effect resulting from the magnetic charges generated in the wall surfaces of grooves cannot be obtained in those parts apart from the grooves. Therefore, the average β angle should be 3° or less. The vicinity of the groove part is intended to be 500 μm or less from each groove, which is the range in which the curvature radius of the coil does not have a significant effect during secondary recrystallization annealing.

To make the β angle of the vicinity of the groove part small, it is of course effective to make the β angle of the secondary recrystallized grain small, but it is also effective to simultaneously use strong inhibitors and make the secondary recrystallized grain size small. Further, it is especially important to inhibit generation of secondary recrystallized grains with shifted orientation from the vicinity of the groove part.

In a method of forming the groove after decarburization annealing, nitriding during final annealing becomes pronounced in the groove part, and secondary recrystallized grains with large β angles are more easily generated from the groove part. Further, a method where a groove is formed by pressing a projection against a rolled sheet is also undesirable since secondary recrystallized grains with large β angles are easily generated from the groove part. Therefore, to make the β angles small, in combination with the necessity to reduce the generation frequency of fine grains under the grooves, as mentioned earlier, a method where a linear groove is formed by etching in a cold rolled sheet is preferable.

Next, conditions of manufacturing a grain oriented electrical steel sheet will be specifically described below.

First, examples of basic elements of the slab (starting material of the present invention) for a grain oriented electrical steel sheet of the present invention are described below. Hereinafter, the indication of "%" regarding the chemical composition of the steel sheet shall stand for "mass %".

C: 0.01% to 0.20%

C is an element useful not only to improve hot rolled microstructure by using transformation, but also to generate the Goss-oriented nuclei, and it is preferably contained in the starting material in an amount of at least 0.01%. On the other hand, if the content of C exceeds 0.20%, it may cause decarburization failure during decarburization annealing. Therefore, the C content in the starting material is preferably 0.01% to 0.20%.

Si: 2.0% to 5.0%

Si is a useful element to increase electric resistance and reduce iron loss, as well as stabilizing the α phase of iron and enabling high temperature heat treatment. It is preferably contained in an amount of at least 2.0%. On the other hand, if the content of Si exceeds 5.0%, workability decreases and it becomes difficult to perform cold rolling. Therefore, the Si content is preferably 2.0% to 5.0%.

Mn: 0.03% to 0.20%

Mn not only effectively contributes to improvement in hot shortness properties of steel, but also forms precipitates such as MnS and MnSe and serves as an inhibitor if S or Se is mixed in the slab. However, if the content of Mn is less than 0.03%, the above effect is insufficient, while if it exceeds 0.20%, the grain size of precipitates such as MnSe coarsens and the effect as an inhibitor will be lost. Therefore, the Mn content is preferably 0.03% to 0.20%. Total of at least one element selected from S and Se: 0.005% to 0.040%

S and Se are useful components which form MnS, MnSe, $Cu_{2-x}S$, $Cu_{2-x}Se$, and the like when bonded to Mn or Cu, and exhibit an effect of an inhibitor as a dispersed second phase in steel. If the total content of S and Se is less than 0.005%, this effect is inadequate, while if the total content exceeds 0.040%, not only does solution formation during slab heating become incomplete, but it becomes the cause of defects on the product surface. Therefore, in either case of independent addition or combined addition, the total content is preferably 0.005% to 0.040%.

sol. Al: 0.010% to 0.05%

Al is a useful element which forms AlN in steel and exhibits an effect of an inhibitor as a dispersed second phase. However, if Al content is less than 0.010%, a sufficient precipitation amount cannot be guaranteed. On the other hand, if Al is added in an amount exceeding 0.05%, AlN is formed as a coarse precipitate and the effect as an inhibitor is lost. Therefore, the sol. Al content is preferably 0.010% to 0.05%.

Further, by using AlN which has a strong inhibiting effect, and in combination with the aforementioned cold rolling conditions, the starting temperature of secondary recrystallization becomes high and the secondary recrystallized nuclei having small β angles selectively grow. Therefore, sol. Al is an essential additive in manufacturing the electrical steel sheet.

N: 0.0015% to 0.020%

N is an element which forms AlN by adding to steel simultaneously with Al. If the additive amount of N is less than 0.0015%, precipitation of AlN or BN becomes insufficient and an inhibiting effect cannot be sufficiently obtained. On the other hand, if N is added in an amount exceeding 0.020%, blistering or the like occurs during slab heating. Therefore, the N content is preferably 0.0015% to 0.020%.

The examples of the basic components are as described above. Further, the following elements may also be contained in the slab according to necessity. At least one element selected from Cu: 0.01% to 0.2%, Ni: 0.01% to 0.5%, Cr: 0.01% to 0.5%, Sb: 0.01% to 0.1%, Sn: 0.01% to 0.5%, Mo: 0.01% to 0.5% and Bi: 0.001% to 0.1%

All of these elements are grain boundary segregation type inhibitor elements and by adding these auxiliary inhibitor elements, the suppressing effect on normal grain growth is further strengthened and it becomes possible to allow preferential growth of secondary recrystallized grains from nuclei with small β angles.

Further, regarding any of the above described elements, i.e. Cu, Ni, Cr, Sb, Sn, Mo and Bi, if the content is less than the lower limit, a sufficient assisting effect on suppressing grain growth cannot be obtained. On the other hand, if any of the above elements is added in an amount exceeding the upper limit, saturation magnetic flux density is decreased and the state of precipitation of the main inhibitor such as AlN is changed and deterioration of magnetic properties is caused. Therefore, each element is preferably contained in the amount within the above ranges.

The balance other than the above components is preferably Fe and incidental impurities that are incorporated into the slab during the manufacturing process.

Then, the slab having the above described chemical composition is subjected to heating and subsequent hot rolling in a conventional manner. The slab may also be subjected to hot rolling directly after casting, without being subjected to heating. In a thin slab or thinner cast steel, it may be subjected to hot rolling or directly proceed to the subsequent step, omitting hot rolling.

Further, the steel sheet is preferably subjected to hot band annealing. At this time, to obtain a further highly-developed Goss texture in a product sheet, the hot band annealing temperature is preferably 800° C. to 1100° C. If the hot band annealing temperature is lower than 800° C., there remains a band texture resulting from hot rolling, which makes it difficult to obtain a primary recrystallized texture of uniformly-sized grains and inhibits the growth of secondary recrystallization. On the other hand, if the hot band annealing temperature exceeds 1100° C., the grain size after the hot band annealing coarsens too much, and makes it difficult to obtain a primary recrystallized texture of uniformly-sized grains.

After hot band annealing, the sheet is subjected to cold rolling once, or twice or more with intermediate annealing performed therebetween until reaching a final sheet thickness. Each cold rolling process is normally performed using a Sendzimir mill or a tandem mill.

Then, after forming the linear grooves by a chemical means with the aforementioned angle formed by each groove and the direction orthogonal to the rolling direction of the steel sheet being 45° or less, the steel sheet is subjected to decarburization annealing and an annealing separator mainly composed of MgO is applied thereon. After the application of the annealing separator, the sheet is subjected to final annealing for purposes of forming secondary recrystallized grains and a forsterite film.

As used herein, the expression of an annealing separator being "mainly composed of MgO" means that the annealing separator may contain other known annealing separator components or physical property-improving components in a range that will not impede the formation of a forsterite film, which is an object of the present invention. Examples of specific compositions will be discussed later.

When a slab of the composition is used, the contents of C, S, Se and N in the resulting steel sheet (not including the coating) are each reduced to 0.005% or less, the content of Al is reduced to 0.01% or less, and the contents of other components are almost the same as those in the slab.

Groove Formation by Chemical Means

By forming grooves in the final cold rolled sheet, it is possible to form a subscale inside the grooves, allowing formation of a sufficient forsterite film inside the groove as well after the final annealing in the subsequent decarburization annealing.

As methods of forming grooves, chemical methods are suitable as they do not change the form of generation of strains or subscales of the steel sheet. In particular, methods such as electrolytic etching or pickling are desirable.

Electrolytic Etching Method

For procedures of the electrolytic etching method, any conventionally known method may be used. In particular, a method of printing a masking part using gravure offset printing and then performing electrolytic etching with an NaCl aqueous solution is desirable.

Pickling Method

For procedures of the pickling method, any conventionally known method may be used. In particular, a method of printing an acid-resistant masking film using gravure offset printing and then performing pickling treatment with an HCl aqueous solution is desirable.

Physical Properties of MgO used in Annealing Separator

To manufacture a grain-oriented electrical steel sheet, it is important to allow formation of the base film of the groove part to proceed. To this end, it is crucial to properly control viscosity among physical properties of MgO which is a main component of the annealing separator. MgO is normally in powder form. However, the viscosity obtained in accordance with the following definition is used as physical properties of MgO.

As MgO herein, either pure MgO or industrially produced MgO including impurities may be used. An example of an industrially produced MgO is disclosed in JPS54-14566B.

An annealing separator mainly composed of MgO in a water slurry state is applied to the steel sheet with grooves present in the steel sheet surface. If the viscosity of the annealing separator is too high, forsterite formation inside the groove becomes insufficient. It is assumed that this is because the annealing separator in the form of slurry did not sufficiently spread and deposit inside the groove. On the other hand, if MgO slurry has low viscosity, the coating mass in the groove part and steel sheet surface becomes too small, and sufficient base film formation is not achieved. For these reasons, it is necessary to restrict the viscosity of MgO which is a main component of the annealing separator. In particular, the appropriate range of viscosity of MgO (measured using a B-type viscometer at 60 rpm, 30 minutes after mixing 250 g of water and 40 g of MgO at 20° C.) is a range from 20 cP to 100 cP. Therefore, viscosity of MgO slurry is used as the index of physical properties of MgO used in the annealing separator and the range of viscosity thereof 30 minutes after mixing with water is 20 cP to 100 cP. The range is preferably 30 cP to 80 cP.

For adjustment of the viscosity of MgO slurry, an ordinary adjusting method of the viscosity of slurry should be used. Possible methods include for example, adjusting the amount of hydration of MgO by changing size, shape, etc. of grains.

As an annealing separator, conventionally known additive components such as $TiO_2$ or $SrSO_4$ may be contained. These additive components other than MgO may be added up to a total amount of around 30 mass % of the solid content of the annealing separator. Further, the viscosity of the annealing separator is preferably around 20 cP to 100 cP.

Temperature/Number of Times of Final Cold Rolling

It is necessary for the average value of β angle to be 3° or less as previously described. As a means for this, it is necessary to use AlN as an inhibitor. Further, it is necessary to prevent the increase of β angle which is caused by the curvature radius of the coil formed during secondary recrystallization annealing, and therefore it is preferable to control final cold rolling conditions and make secondary recrystallized grain sizes small.

Possible specific means to achieve the above steel sheet microstructure include increasing the temperature of final cold rolling. By doing so, it is possible to increase the formation frequency of Goss-oriented portions which become the seeds of secondary recrystallized grains in the rolled texture, and make the secondary recrystallized grain size small. During the cold rolling, the steel sheet is subjected to rolling at least once during which the entry temperature or the delivery temperature of the rolling stand, whichever is higher, is 170° C. or lower, and to rolling at least twice during which the higher temperature of the two is 200° C. or higher. Consequently, it is possible to make the secondary recrystallized grain size even finer without deteriorating secondary recrystallized grain orientation. Although the reason for this is not clear, it is assumed that the combined action of the worked microstructure introduced at low temperature and the worked microstructure introduced at high temperature finally increases the Goss-oriented nuclei.

For the rolling during which the entry temperature or the delivery temperature of the rolling stand, whichever is higher, is 200° C. or higher, the upper limit of the higher temperature is preferably set to 280° C. from the perspective of operation. On the other hand, for the other rolling during which the higher temperature is 170° C. or lower, the lower limit is preferably set to room temperature from the perspective of operation.

After the final annealing, it is effective to subject the steel sheet to flattening annealing to correct the shape thereof. An insulation coating can be applied to the steel sheet surface before or after the flattening annealing. The term "insulation coating" refers to a coating that can apply tension to the steel sheet to reduce iron loss (hereinafter, referred to as "tension coating"). Examples of the tension coating include an inorganic coating containing silica, and a ceramic coating by physical vapor deposition, chemical vapor deposition, and so on.

Other than the above-described steps and manufacturing conditions, methods of manufacturing grain-oriented electrical steel sheets subjected to magnetic domain refining treatment by forming grooves through conventionally known chemical methods may be adopted.

EXAMPLES

Example 1

Steel slabs, each containing C: 0.06%, Si: 3.3%, Mn: 0.08%, S: 0.023%, Al: 0.03%, N: 0.007%, Cu: 0.2%, Sb: 0.02%, and the balance of Fe and unavoidable impurities, were heated at 1430° C. for 30 minutes, and then subjected to hot rolling to obtain hot rolled steel sheets with a sheet thickness of 2.2 mm, which in turn were subjected to annealing at 1000° C. for 1 minute, and then cold rolling until reaching a sheet thickness of 1.5 mm, and then intermediate annealing at 1100° C. for 2 minutes, and then cold rolling to have a final sheet thickness of 0.23 mm. Then, linear grooves were formed through electrolytic etching or rolling reduction using rollers with protrusions. Then, decarburization annealing was performed at 840° C. for 2 minutes, and by mixing a mixed powder containing 90 mass % of MgO having a physical property value of viscosity (30 minutes after mixing with water) shown in table 1 and 10 mass % of $TiO_2$, with water (solid component ratio of 15 mass %), and stirring the mixture for 30 minutes to form a slurry. In this way, the annealing separators with the viscosities shown in table 1 were obtained. Then, the annealing separators were applied to the respective steel sheets, and the steel sheets were wound into coils, and the coils were subjected to final annealing. Then, a phosphate-based insulating tension coating was applied and baked thereon, and flattening annealing was performed for the purpose of flattening the steel strips to obtain products.

Some of these products were subjected to final annealing, and then rolling reduction using rollers with protrusions before flattening annealing to form linear grooves. Under the conditions for test sample No. 26, a steel sheet was subjected to final annealing and grooves were formed thereon using rollers with protrusions, then the steel sheet was wound into a coil and subjected to annealing at 1200° C. for 5 hours to extinguish fine grains under the groove.

From the products obtained as described above, Epstein test specimens were collected, and then subjected to stress relief annealing in nitrogen atmosphere at 800° C. for 3 hours, and then iron loss $W_{17/50}$ was measured by conducting an Epstein test.

The measurement results of magnetic properties of the products obtained as described above are shown in Table 1.

Figure 2:
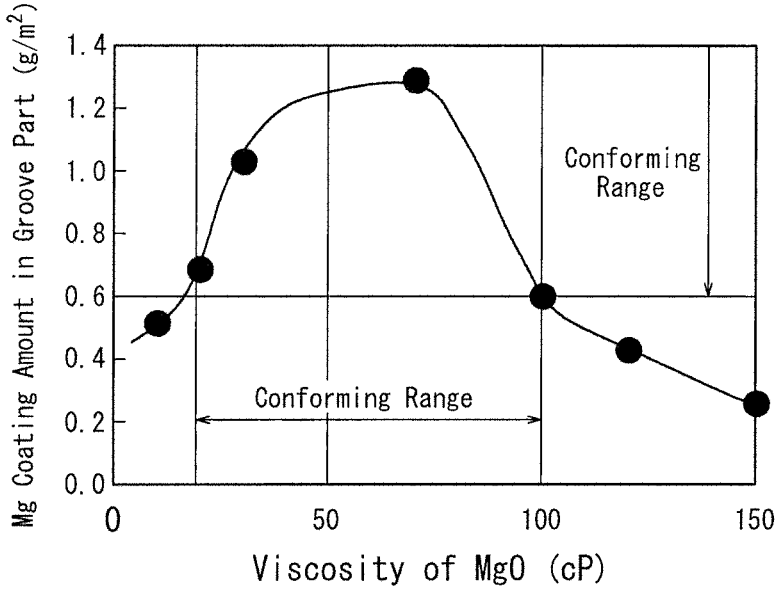
FIG. 2 shows the relation between viscosity of MgO and Mg coating amount in the floor portions of grooves.
Figure 3:
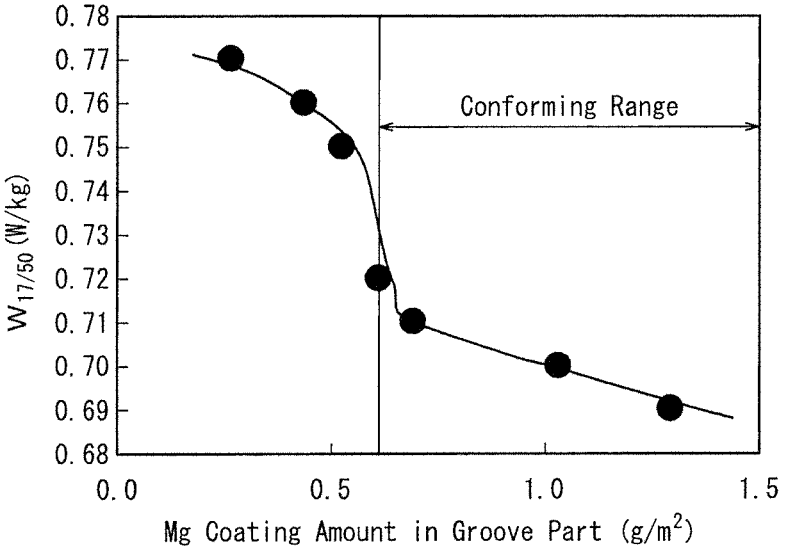
FIG. 3 shows the relation between Mg coating amount in the groove part and iron loss $W_{17/50}$.
Figure 4:
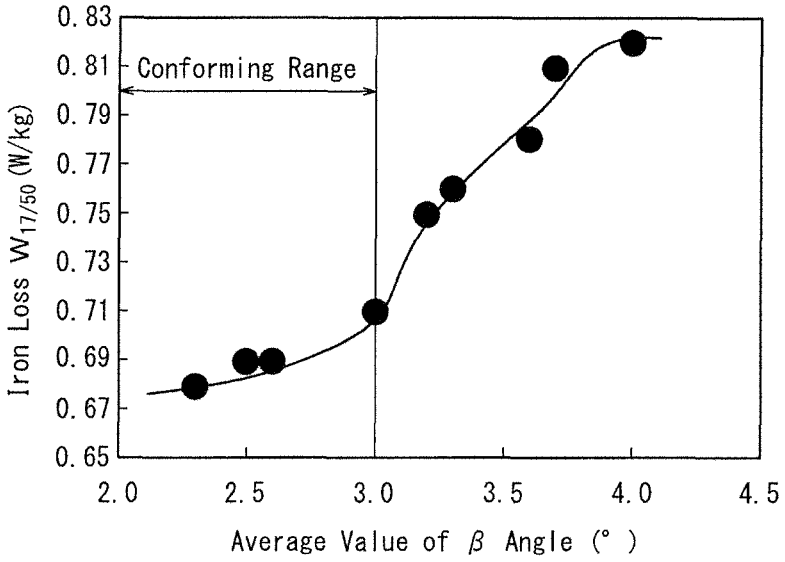
FIG. 4 shows the relation between average value of β angle and iron loss $W_{17/50}$.
Figure 5:
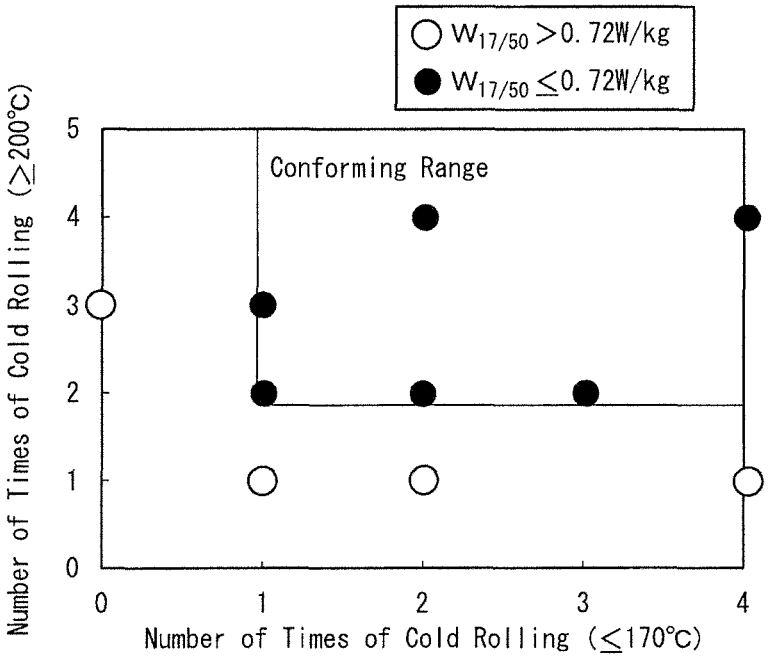
FIG. 5 shows the relation between cold rolling temperature and iron loss $W_{17/50}$.

The relations between viscosity of MgO (of 30 minutes after mixing with water) as a physical property value and Mg coating amount in the groove part, Mg coating amount in the groove part and iron loss, average value of β angle and iron loss are each shown in FIGS. 2 to 4. Further, the relation between combinations of temperature conditions of cold rolling and iron loss values is shown in FIG. 5.

TABLE 1

| Test No. | Groove Forming Method | Groove Forming Treatment Step | Additional Step | Angle of Groove in relation to Direction Orthogonal to Rolling Direction (°) | Viscosity of MgO (cP) | Viscosity of Annealing Separator (cP) | Final Cold Rolling 170° C. or Lower (Number of Times) | Final Cold Rolling 200° C. or Higher (Number of Times) |
|---|---|---|---|---|---|---|---|---|
| 1 | Electrolytic Etching | After Final Cold Rolling | — | 60 | 20 | 18 | 1 | 3 |
| 2 | Electrolytic Etching | After Final Cold Rolling | — | 45 | 20 | 19 | 1 | 3 |

TABLE 1-continued

| | | | | | | | | |
|---|---|---|---|---|---|---|---|---|
| 3 | Electrolytic Etching | After Final Cold Rolling | — | 10 | 10 | 10 | 1 | 3 |
| 4 | Electrolytic Etching | After Final Cold Rolling | — | 10 | 20 | 18 | 1 | 3 |
| 5 | Electrolytic Etching | After Final Cold Rolling | — | 10 | 30 | 27 | 1 | 3 |
| 6 | Electrolytic Etching | After Final Cold Rolling | — | 10 | 70 | 68 | 1 | 3 |
| 7 | Electrolytic Etching | After Final Cold Rolling | — | 10 | 100 | 94 | 1 | 3 |
| 8 | Electrolytic Etching | After Final Cold Rolling | — | 10 | 120 | 115 | 1 | 3 |
| 9 | Electrolytic Etching | After Final Cold Rolling | — | 10 | 150 | 142 | 1 | 3 |
| 10 | Electrolytic Etching | After Final Cold Rolling | — | 10 | 30 | 28 | 0 | 3 |
| 11 | Electrolytic Etching | After Final Cold Rolling | — | 10 | 30 | 27 | 2 | 1 |
| 12 | Electrolytic Etching | After Final Cold Rolling | — | 10 | 30 | 27 | 4 | 1 |
| 13 | Electrolytic Etching | After Final Cold Rolling | — | 10 | 30 | 29 | 1 | 1 |
| 14 | Electrolytic Etching | After Final Cold Rolling | — | 10 | 30 | 30 | 2 | 4 |
| 15 | Electrolytic Etching | After Final Cold Rolling | — | 10 | 30 | 28 | 4 | 4 |
| 16 | Electrolytic Etching | After Final Cold Rolling | — | 10 | 30 | 29 | 2 | 2 |
| 17 | Electrolytic Etching | After Final Cold Rolling | — | 10 | 30 | 28 | 1 | 2 |
| 18 | Pickling | After Final Cold Rolling | — | 10 | 30 | 27 | 1 | 3 |
| 19 | Rollers with Protrusions | After Final Cold Rolling | — | 10 | 30 | 27 | 3 | 2 |
| 20 | Rollers with Protrusions | After Final Annealing | — | 10 | 30 | 28 | 1 | 3 |
| 21 | Electrolytic Etching | After Final Cold Rolling | — | 10 | 30 | 29 | 1 | 3 |
| 22 | Electrolytic Etching | After Final Cold Rolling | — | 10 | 30 | 27 | 1 | 3 |
| 23 | Electrolytic Etching | After Final Cold Rolling | — | 10 | 30 | 28 | 1 | 3 |
| 24 | Electrolytic Etching | After Final Cold Rolling | — | 10 | 30 | 28 | 1 | 3 |
| 25 | Electrolytic Etching | After Final Cold Rolling | — | 10 | 30 | 29 | 1 | 3 |
| 26 | Rollers with Protrusions | After Final Annealing | After Forming Groove, Additional Annealing at 1200° C. for 5 Hours | 10 | 30 | 28 | 1 | 3 |

| Test No. | Mg Coating Amount of Parts other than Groove Part ($g/m^2$) | Mg Coating Amount of Groove Part ($g/m^2$) | Presence Ratio of Fine Grains in Floor of Groove (%) | Average Value of β Angle in Vicinity of Groove (°) | Iron Loss $W_{17/50}$ (W/kg) | Remarks |
|---|---|---|---|---|---|---|
| 1 | 1.30 | 0.69 | 1.0 | 2.1 | 0.77 | Comparative Example |
| 2 | 1.32 | 0.69 | 1.0 | 2.1 | 0.72 | Inventive Example |
| 3 | 0.64 | 0.51 | 1.0 | 2.0 | 0.75 | Comparative Example |
| 4 | 0.96 | 0.69 | 0.9 | 2.0 | 0.71 | Inventive Example |
| 5 | 1.36 | 1.03 | 0.9 | 2.0 | 0.70 | Inventive Example |
| 6 | 1.36 | 1.29 | 1.0 | 2.0 | 0.69 | Inventive Example |
| 7 | 1.36 | 0.60 | 1.0 | 2.0 | 0.72 | Inventive Example |
| 8 | 1.38 | 0.43 | 1.0 | 2.0 | 0.76 | Comparative Example |
| 9 | 1.40 | 0.26 | 1.0 | 2.0 | 0.77 | Comparative Example |
| 10 | 1.32 | 1.11 | 0.9 | 3.2 | 0.75 | Comparative Example |

TABLE 1-continued

| | | | | | | |
|---|---|---|---|---|---|---|
| 11 | 1.32 | 1.11 | 0.9 | 3.3 | 0.76 | Comparative Example |
| 12 | 1.32 | 1.11 | 0.9 | 3.7 | 0.81 | Comparative Example |
| 13 | 1.34 | 1.11 | 0.9 | 4.0 | 0.82 | Comparative Example |
| 14 | 1.32 | 1.11 | 0.9 | 2.5 | 0.69 | Inventive Example |
| 15 | 1.34 | 1.11 | 0.9 | 2.3 | 0.68 | Inventive Example |
| 16 | 1.36 | 1.11 | 0.9 | 2.5 | 0.69 | Inventive Example |
| 17 | 1.30 | 1.11 | 0.9 | 2.6 | 0.69 | Inventive Example |
| 18 | 1.42 | 1.03 | 0.9 | 3.0 | 0.71 | Inventive Example |
| 19 | 1.36 | 1.03 | 0.9 | 3.6 | 0.78 | Comparative Example |
| 20 | 1.34 | 0.77 | 40 | 2.1 | 0.75 | Comparative Example |
| 21 | 1.38 | 1.03 | 1.0 | 2.1 | 0.69 | Inventive Example |
| 22 | 1.38 | 1.03 | 1.0 | 2.1 | 0.69 | Inventive Example |
| 23 | 1.38 | 1.03 | 1.0 | 2.1 | 0.68 | Inventive Example |
| 24 | 1.34 | 1.03 | 1.0 | 2.1 | 0.68 | Inventive Example |
| 25 | 1.36 | 1.03 | 1.0 | 2.1 | 0.67 | Inventive Example |
| 26 | 1.34 | 0.48 | 0.7 | 2.1 | 0.75 | Comparative Example |

As shown in Table 1, products using grain-oriented electrical steel sheets (test Nos. 2, 4 to 7, 14 to 18 and 21 to 25), all exhibited excellent magnetic properties of $W_{17/50} \leq 0.72$ W/kg.

Under the conditions of the above test No. 26, fine grains under the groove disappeared. However, since the base film of the groove part was peeled through rolling reduction by rollers with protrusions, the Mg coating amount defined was not sufficiently guaranteed, and therefore low iron loss properties were not achieved. Further, test Nos. 1, 3, 8 to 13, 19 and 20 which do not satisfy either one of our ranges all showed poor iron loss.

Example 2

Steel slabs containing components shown in Tables 2-1 and 2-2 were heated at 1430° C. for 30 minutes, subjected to hot rolling to obtain hot rolled sheets with sheet thickness of 2.2 mm, then the steel sheets were subjected to annealing at 1000° C. for 1 minute, cold rolling until reaching a sheet thickness of 1.5 mm, intermediate annealing at 1100° C. for 2 minutes, and then cold rolling under the conditions shown in table 3 (2 passes with the maximum temperature of the entry and delivery sides being 170° C. or lower, 3 passes with the maximum temperature of the entry and delivery sides being 200° C. or higher) to obtain a final sheet thickness of 0.23 mm. Then, linear grooves were formed thereon by electrolytic etching.

Then, after performing decarburization annealing at 840° C. for 2 minutes, an annealing separator mainly composed (93 mass %) of MgO (viscosity (30 minutes after mixing with water) of 40 cP) with 6 mass % of $TiO_2$ and 1 mass % of $SrSO_4$ each added was mixed with water (solid component ratio of 15 mass %), stirred for 30 minutes to form a slurry (viscosity of 30 cP) and applied to the steel sheets. Then, the steel sheets were wound into coils, and the coils were subjected to final annealing. Then, a phosphate-based insulating tension coating was applied and baked, and flattening annealing was performed for the purpose of flattening steel strips to obtain the products.

From the products obtained as described above, Epstein test specimens were collected, and then subjected to stress relief annealing in nitrogen atmosphere at 800° C. for 3 hours, and then iron loss $W_{17/50}$ was measured by conducting an Epstein test.

Magnetic properties of the products obtained as described above are shown in Tables 2-1 and 2-2.

TABLE 2-1

| Test | Steel Composition (mass %) | | | | | | | | | Mg Coating Amount of Groove Part | Presence Ratio of Fine Grains in Floor of | β Angle | Iron Loss $W_{17/50}$ | |
|---|---|---|---|---|---|---|---|---|---|---|---|---|---|---|
| No. | C | Si | Mn | S | Se | S + Se | sol. Al | N | Others | (g/m²) | Groove (%) | (°) | (W/kg) | Remarks |
| 1 | 0.005 | 3.1 | 0.1 | 0.02 | tr. | 0.02 | 0.03 | 0.0100 | — | 0.6 | 1.0 | 4.2 | 0.85 | Comparative Example |
| 2 | 0.10 | 3.1 | 0.1 | 0.02 | tr. | 0.02 | 0.03 | 0.0100 | — | 0.7 | 1.1 | 2.9 | 0.72 | Inventive Example |
| 3 | 0.20 | 3.1 | 0.1 | 0.02 | tr. | 0.02 | 0.03 | 0.0100 | — | 1.0 | 2.3 | 2.7 | 0.70 | Inventive Example |

TABLE 2-1-continued

| Test No. | Steel Composition (mass %) C | Si | Mn | S | Se | S + Se | sol. Al | N | Others | Mg Coating Amount of Groove Part ($g/m^2$) | Presence Ratio of Fine Grains in Floor of Groove (%) | β Angle (°) | Iron Loss $W_{17/50}$ (W/kg) | Remarks |
|---|---|---|---|---|---|---|---|---|---|---|---|---|---|---|
| 4 | 0.30 | 3.1 | 0.1 | 0.02 | tr. | 0.02 | 0.03 | 0.0100 | — | 1.2 | 4.0 | 3.3 | 0.76 | Comparative Example |
| 5 | 0.10 | 1.0 | 0.1 | 0.02 | tr. | 0.02 | 0.03 | 0.0100 | — | 0.5 | 2.1 | 3.0 | 0.77 | Comparative Example |
| 6 | 0.10 | 2.0 | 0.1 | 0.02 | tr. | 0.02 | 0.03 | 0.0100 | — | 1.0 | 1.5 | 2.5 | 0.72 | Inventive Example |
| 7 | 0.10 | 3.1 | 0.1 | 0.02 | tr. | 0.02 | 0.03 | 0.0100 | — | 1.1 | 1.2 | 2.6 | 0.71 | Inventive Example |
| 8 | 0.10 | 5.0 | 0.1 | 0.02 | tr. | 0.02 | 0.03 | 0.0100 | — | 1.0 | 1.1 | 2.6 | 0.69 | Inventive Example |
| 9 | 0.10 | 7.0 | 0.1 | 0.02 | tr. | 0.02 | 0.03 | 0.0100 | — | 1.1 | 1.2 | 3.9 | 0.81 | Comparative Example |
| 10 | 0.10 | 3.1 | 0.02 | 0.02 | tr. | 0.02 | 0.03 | 0.0100 | — | 1.1 | 1.3 | 3.8 | 0.80 | Comparative Example |
| 11 | 0.10 | 3.1 | 0.03 | 0.02 | tr. | 0.02 | 0.03 | 0.0100 | — | 1.1 | 1.2 | 2.7 | 0.71 | Inventive Example |
| 12 | 0.10 | 3.1 | 0.1 | 0.02 | tr. | 0.02 | 0.03 | 0.0100 | — | 1.2 | 1.1 | 2.6 | 0.71 | Inventive Example |
| 13 | 0.10 | 3.1 | 0.2 | 0.02 | tr. | 0.02 | 0.03 | 0.0100 | — | 1.3 | 1.5 | 2.6 | 0.68 | Inventive Example |
| 14 | 0.10 | 3.1 | 0.3 | 0.02 | tr. | 0.02 | 0.03 | 0.0100 | — | 1.3 | 1.2 | 3.3 | 0.77 | Comparative Example |
| 15 | 0.10 | 3.1 | 0.1 | tr. | 0.001 | 0.001 | 0.03 | 0.0100 | — | 1.1 | 1.2 | 4.1 | 0.84 | Comparative Example |
| 16 | 0.10 | 3.1 | 0.1 | tr. | 0.005 | 0.005 | 0.03 | 0.0100 | — | 1.2 | 1.5 | 2.9 | 0.72 | Inventive Example |
| 17 | 0.10 | 3.1 | 0.1 | 0.002 | 0.003 | 0.005 | 0.03 | 0.0100 | — | 1.2 | 1.2 | 2.8 | 0.72 | Inventive Example |
| 18 | 0.10 | 3.1 | 0.1 | 0.005 | 0.005 | 0.01 | 0.03 | 0.0100 | — | 1.2 | 1.2 | 2.7 | 0.71 | Inventive Example |
| 19 | 0.10 | 3.1 | 0.1 | 0.01 | 0.01 | 0.02 | 0.03 | 0.0100 | — | 1.1 | 1.3 | 2.7 | 0.70 | Inventive Example |
| 20 | 0.10 | 3.1 | 0.1 | 0.02 | 0.02 | 0.04 | 0.03 | 0.0100 | — | 1.1 | 1.2 | 2.6 | 0.70 | Inventive Example |
| 21 | 0.10 | 3.1 | 0.1 | tr. | 0.04 | 0.04 | 0.03 | 0.0100 | — | 1.1 | 1.4 | 2.7 | 0.70 | Inventive Example |
| 22 | 0.10 | 3.1 | 0.1 | 0.04 | 0.02 | 0.06 | 0.03 | 0.0100 | — | 1.1 | 12.3 | 2.9 | 0.76 | Comparative Example |
| 23 | 0.10 | 3.1 | 0.1 | 0.02 | tr. | 0.02 | 0.005 | 0.0100 | — | 0.8 | 4.3 | 3.9 | 0.81 | Comparative Example |

The balance of the steel composition is Fe and incidental impurities.

TABLE 2-2

| Test No. | Steel Composition (mass %) C | Si | Mn | S | Se | S + Se | sol. Al | N | Others | Mg Coating Amount of Groove Part ($g/m^2$) | Presence Ratio of Fine Grains in Floor of Groove (%) | β Angle (°) | Iron Loss $W_{17/50}$ (W/kg) | Remarks |
|---|---|---|---|---|---|---|---|---|---|---|---|---|---|---|
| 24 | 0.10 | 3.1 | 0.1 | 0.02 | tr. | 0.02 | 0.01 | 0.0100 | — | 0.9 | 3.2 | 2.9 | 0.72 | Inventive Example |
| 25 | 0.10 | 3.1 | 0.1 | 0.02 | tr. | 0.02 | 0.03 | 0.0100 | — | 1.0 | 1.0 | 2.7 | 0.69 | Inventive Example |
| 26 | 0.10 | 3.1 | 0.1 | 0.02 | tr. | 0.02 | 0.05 | 0.0100 | — | 1.0 | 1.2 | 2.9 | 0.72 | Inventive Example |
| 27 | 0.10 | 3.1 | 0.1 | 0.02 | tr. | 0.02 | 0.08 | 0.0100 | — | 0.9 | 1.1 | 7.2 | 0.91 | Comparative Example |
| 28 | 0.10 | 3.1 | 0.1 | 0.02 | tr. | 0.02 | 0.03 | 0.0005 | — | 0.8 | 8.6 | 3.8 | 0.77 | Comparative Example |
| 29 | 0.10 | 3.1 | 0.1 | 0.02 | tr. | 0.02 | 0.03 | 0.0010 | — | 1.0 | 5.1 | 2.9 | 0.72 | Inventive Example |
| 30 | 0.10 | 3.1 | 0.1 | 0.02 | tr. | 0.02 | 0.03 | 0.0050 | — | 1.0 | 2.1 | 2.6 | 0.71 | Inventive Example |
| 31 | 0.10 | 3.1 | 0.1 | 0.02 | tr. | 0.02 | 0.03 | 0.0100 | — | 1.0 | 1.1 | 2.5 | 0.69 | Inventive Example |
| 32 | 0.10 | 3.1 | 0.1 | 0.02 | tr. | 0.02 | 0.03 | 0.0200 | — | 1.1 | 1.2 | 2.9 | 0.68 | Inventive Example |
| 33 | 0.10 | 3.1 | 0.1 | 0.02 | tr. | 0.02 | 0.03 | 0.0300 | — | 0.9 | 1.4 | 5.2 | 0.86 | Comparative Example |

TABLE 2-2-continued

| Test | Steel Composition (mass %) | | | | | | | | | Mg Coating Amount of Groove Part | Presence Ratio of Fine Grains in Floor of | β Angle | Iron Loss $W_{17/50}$ | |
|---|---|---|---|---|---|---|---|---|---|---|---|---|---|---|
| No. | C | Si | Mn | S | Se | S + Se | sol. Al | N | Others | ($g/m^2$) | Groove (%) | (°) | (W/kg) | Remarks |
| 34 | 0.10 | 3.1 | 0.1 | tr. | 0.02 | 0.02 | 0.03 | 0.0100 | Sb: 0.05 | 0.7 | 0.9 | 2.2 | 0.67 | Inventive Example |
| 35 | 0.10 | 3.1 | 0.1 | tr. | 0.02 | 0.02 | 0.03 | 0.0100 | Sn: 0.05 | 1.0 | 0.8 | 2.1 | 0.66 | Inventive Example |
| 36 | 0.10 | 3.1 | 0.1 | tr. | 0.02 | 0.02 | 0.03 | 0.0100 | Sb: 0.05<br>Cu: 0.1 | 0.8 | 0.7 | 2.0 | 0.67 | Inventive Example |
| 37 | 0.10 | 3.1 | 0.1 | tr. | 0.02 | 0.02 | 0.03 | 0.0100 | Sb: 0.05<br>Cu: 0.1<br>Mo: 0.05 | 0.6 | 0.9 | 1.8 | 0.67 | Inventive Example |
| 38 | 0.10 | 3.1 | 0.1 | tr. | 0.02 | 0.02 | 0.03 | 0.0100 | Sb: 0.05<br>Bi: 0.01 | 0.7 | 0.2 | 1.4 | 0.66 | Inventive Example |
| 39 | 0.10 | 3.1 | 0.1 | tr. | 0.02 | 0.02 | 0.03 | 0.0100 | Sb: 0.05<br>Cu: 0.1<br>Ni: 0.1<br>Cr: 0.1 | 1.1 | 0.5 | 1.7 | 0.66 | Inventive Example |
| 40 | 0.10 | 3.1 | 0.1 | tr. | 0.02 | 0.02 | 0.03 | 0.0100 | Cr: 0.1<br>Sn: 0.1<br>Cu: 0.05 | 1.2 | 0.6 | 1.8 | 0.67 | Inventive Example |
| 41 | 0.10 | 3.1 | 0.1 | tr. | 0.02 | 0.02 | 0.03 | 0.0100 | Ni: 0.2<br>Cu: 0.1<br>Sn: 0.02 | 1.0 | 0.9 | 1.7 | 0.67 | Inventive Example |

The balance of the steel composition is Fe and incidental impurities.

TABLE 3

| Number of Rolling Passes (Rolling Stand No.) | Entry Temperature of Rolling (° C.) | Delivery Temperature of Rolling (° C.) |
|---|---|---|
| 1 | 30 | 150 |
| 2 | 80 | 190 |
| 3 | 140 | 200 |
| 4 | 160 | 220 |
| 5 | 170 | 220 |
| 6 | 170 | 100 |

Products using grain oriented electrical steel sheets according to our methods (test Nos. 2, 3, 6 to 8, 11 to 13, 16 to 21, 24 to 26, 29 to 32, 34 to 41), all exhibited excellent magnetic properties of $W_{17/50} \leq 0.72$ W/kg. Further, as previously mentioned, it is understood that by adding Cu, Ni, Cr, Sb, Sn, Mo and Bi in a predetermined amount, products with even lower iron loss can be obtained. In contrast, test Nos. 1, 4, 5, 9, 10, 14, 15, 22, 23, 27, 28 and 33 which do not satisfy either one of our ranges all showed poor iron loss properties.

The invention claimed is:

1. A grain-oriented electrical steel sheet comprising a linear groove formed on a surface thereof and extending in a direction forming an angle of 45° or less with a direction orthogonal to a rolling direction of the steel sheet, wherein presence frequency of fine grains with a length in the rolling direction of 1 mm or less in a floor portion of the groove is 10% or less, including 0% indicative of the absence of fine grains, the groove is provided with a forsterite film in an amount of 0.6 $g/m^2$ or more and 3.0 $g/m^2$ or less in terms of Mg coating amount per one surface of the steel sheet, and an average of angles (β angles) formed by <100> axes of secondary recrystallized grains facing the rolling direction and a rolling plane of the steel sheet is 3° or less.

* * * * *